US007997570B2

(12) United States Patent
De Matteis

(10) Patent No.: US 7,997,570 B2
(45) **Date of Patent: *Aug. 16, 2011**

(54) METHOD AND APPARTUS FOR SEPARATION OF STACKS OF INTERFOLDED SHEETS

(75) Inventor: Alessandro De Matteis, Picciorana (IT)

(73) Assignee: MTC-Macchine Trasformazione Carta S.r.l., Porcari (IT)

( * ) Notice: Subject to any disclaimer, the term of this patent is extended or adjusted under 35 U.S.C. 154(b) by 9 days.

This patent is subject to a terminal disclaimer.

(21) Appl. No.: 12/330,901

(22) Filed: Dec. 9, 2008

(65) Prior Publication Data

US 2009/0208319 A1 Aug. 20, 2009

Related U.S. Application Data

(63) Continuation of application No. 10/697,765, filed on Oct. 30, 2003, now abandoned.

(30) Foreign Application Priority Data

Oct. 31, 2002 (EP) ..... 02425669

(51) Int. Cl.
*B65H 33/00* (2006.01)
*B65H 31/32* (2006.01)
*B65H 45/12* (2006.01)

(52) U.S. Cl. ..... 270/39.02; 270/39.05; 493/357; 414/789.9

(58) Field of Classification Search ..... 414/789.5; 270/39–39.091; 493/413–415, 420; 225/100
See application file for complete search history.

(56) References Cited

U.S. PATENT DOCUMENTS

| | | | |
|---|---|---|---|
| 4,721,295 | A | 1/1988 | Hathaway |
| 4,725,469 | A | 2/1988 | Summerfield |
| 4,770,402 | A | 9/1988 | Couturier |
| 4,874,158 | A | 10/1989 | Retzloff |
| 5,088,707 | A | 2/1992 | Stemmler |
| 5,730,695 | A | 3/1998 | Hauschild et al. |
| 6,228,014 | B1 | 5/2001 | De Matteis et al. |
| 6,322,315 | B1 | 11/2001 | Schmidt et al. |
| 2006/0073007 | A1 | 4/2006 | De Matteis |

FOREIGN PATENT DOCUMENTS

| | | |
|---|---|---|
| JP | 407053122 | 8/1993 |
| JP | 407291527 | 4/1994 |

*Primary Examiner* — Gregory W Adams
(74) *Attorney, Agent, or Firm* — Dennison, Schultz & MacDonald

(57) ABSTRACT

The sheets are supplied interfolded by two folding rollers, on a table on which they are piled up forming a stack. When the stack achieves a predetermined height a first plurality of separators and a second plurality of separators, arranged for all the length of the stack and from opposite sides are inserted into the stack to provide the disengagement of the stack already formed from a stack being formed, leaving between them of a wing of sheet hanging. The stack formed is then withdrawn quickly from the stack being formed by means of a table, which translates vertically, and is subject to a blow of air for stretching a possible last sheet. Then, the stack formed is left on a longitudinal conveyor belt located underneath. At the same time, a sheet stretching board moves under the stack of interfolded sheets, for all its length, for provisional support thereof and for stretching completely the wing hanging from the stack being formed with a portion of wing that exceeds sheet stretching board. Then the separators and withdraw laterally and an element moving from a direction opposite to the sheet stretching board, for example a blow of air, stretches the portion of the exceeding wing of sheet just before that the table comes back.

12 Claims, 6 Drawing Sheets

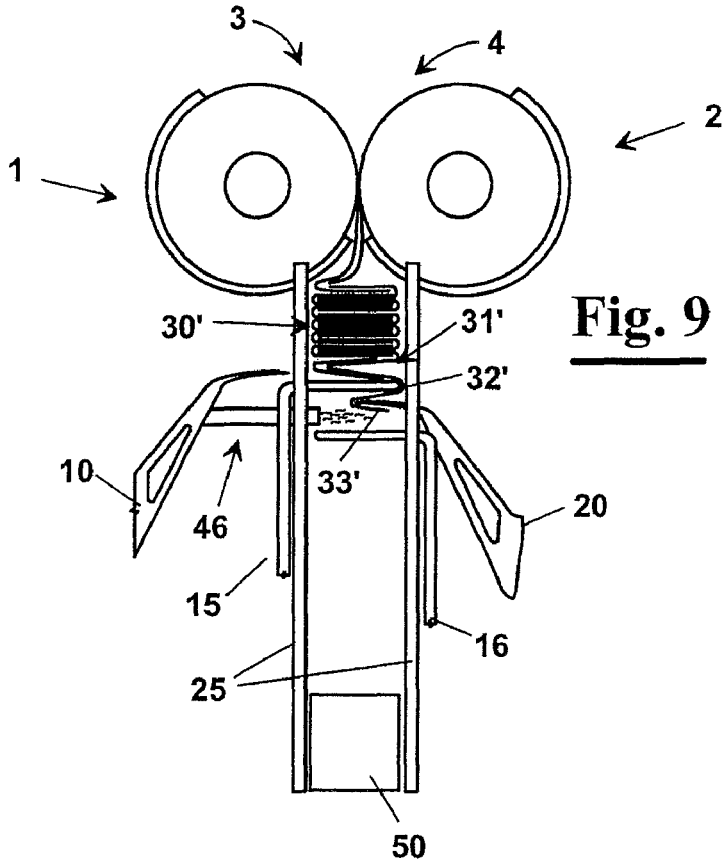
Fig. 9
Fig. 10
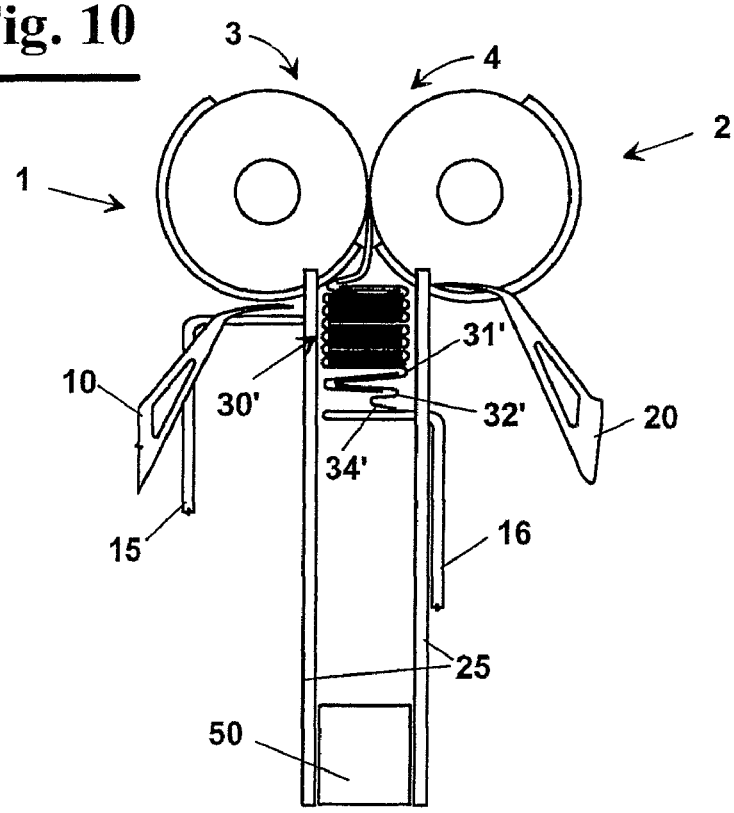

METHOD AND APPARTUS FOR SEPARATION OF STACKS OF INTERFOLDED SHEETS

CROSS-REFERENCE TO RELATED APPLICATIONS

This application is a continuation of U.S. patent application Ser. No. 10/697,765, filed Oct. 30, 2003, which claims priority to European Patent Application No. 02425669.5, filed Oct. 31, 2002, the disclosures of which are incorporated herein by reference in their entirety.

FIELD OF THE INVENTION

The present invention relates to the production of stacked paper material and in particular it relates to a method for separating two successive stacks of interfolded sheets in order to obtain stacks with a predetermined number of sheets.

Furthermore, the invention relates to an apparatus that carries out this method.

BACKGROUND OF THE INVENTION

As known, in the paper industry a variety of types of machines and of processes are used for making handkerchiefs, paper towels and the like in packages of interfolded sheets of a certain stack height.

They are obtained stacking the sheets in an "interfolded" way, i.e. at each fold a wing of the previous sheet and a wing of the next sheet engage with each other. This way, when drawing a sheet from the package, at the moment of the use also a wing of the next sheet protrudes, with subsequent practical employment for certain types of users. Among the possible interfolding ways the L, Z or W interfolded sheets are known respectively with 2, 3 and 4 folds per sheet.

A particularly critical step of the process of production of packages of interfolded sheets is the separation of a stack from the next one once achieved a determined height of the pack. In paper industry, in fact, high speed working is necessary during the whole production process and the step of separation of successive stacks of sheets represents a critical point of the whole process since it needs a succession of operations that unavoidably slows down productivity.

For this reason solutions are looked for to provide the high speed separation of the stacks.

The different existing apparatus have all a couple of folding rollers that supply the interfolded sheets on a table and, in some cases, a plurality of "folding arms" that go in and out special grooves made in the folding rollers, thus forming a stack of interfolded sheets on the table.

In U.S. Pat. No. 4,770,402, when the stack of sheets present on the table reaches a certain height, a first series of means of separation moves into the stack from a side whereas a second plurality moves into the stack from the opposite side, and both for all its width. This way, a pack is separated from the next one and precisely the pack of predetermined height is arranged between the table and the first series of means of separation, whereas the other series of means of separation supports the pack being formed up to the moment when the table comes back. The latter, in fact, leaves the pack with the predetermined height on a conveyor belt and moves back in the stack receiving position for receiving the pack.

These machines have, however, different drawbacks which are caused by the shape and the way of operating the means of separation.

The means of separation as above described, in fact, all rotate about an axis for their introduction and the withdrawal into/from the stack being formed. Furthermore, to assure an effective separating action, owing to the width of the means of separation, it is necessary that the latter are inserted into the stack in a high position, near the point of contact of the folding rollers. Therefore, it is necessary that the folding rollers are subject to an additional machining for making the necessary boundary grooves with subsequent additional costs for the machine. Furthermore, the presence of such grooves, making a structural irregularity, limits substantially the quality of the final product and the maximum speed of the machine.

A solution for avoiding to make the boundary grooves in the folding rollers is described in U.S. Pat. No. 5,730,695, where the means of separation enter into the stack only for a portion of its width and from both sides, for allowing a wing of sheet to protrude downwards. At the moment of separation, furthermore, a sheet is withdrawn, and then inserted again into the formed stack, after the next separation.

Also the table is provided in two halves capable of opening for allowing to a wing of sheet to hang towards below. However, the fact of withdrawing a sheet from the stack and insert it again into the formed stack is a drawback. This has the consequence that, in fact, at the moment of the use a sheet is wasted, since it exits double from the pack. Or, that sheet remains on the bottom of the box, since it is difficult to pick up.

SUMMARY OF THE INVENTION

It is therefore a feature of the present invention to provide a method for separating two successive interfolded sheets, during the production of paper products in stacks of interfolded sheets, which does not need withdrawing a sheet.

It is another feature of the present invention to provide a method for separating two successive sheets, during the production of paper products in stacks of interfolded sheets, which allows to provide quickly and precisely the fold for grasping the first sheet of the pack.

It is a further feature of the present invention to provide an apparatus for separating two successive sheets, during the production of paper products in stacks of interfolded sheets, structurally much easier and cheap with respect to apparatus of prior art, without in particular making too many circumferential grooves on the folding rollers.

These and other features are accomplished with the method, according to the present invention, for separating a stack of sheets already formed from a stack being formed, during the production of paper products in stacks, comprising the steps of:

- formation of a stack of interfolded sheets that are piled up on a table located underneath;
- separation of two successive interfolded sheets once achieved a predetermined height of the stack being formed, thus defining a completed stack and a stack being formed;
- said separation occurring by lateral introduction of a first and a second separator in the stack being formed and from opposite sides with respect to the stack same for about half of its width in order to separate the stack located underneath and to leave at least one wing of sheet hanging free between said two separators;
- moving away the stack of sheets already completed by means of the table and locating the stack same on a conveyor belt or an outlet plane;

whose main feature is of providing, after said introduction, the following steps:

moving a sheet stretching board suitable for provisionally supporting the stack and stretching said or each wing, with a portion of wing of sheet exceeding the sheet stretching board;

withdrawing said first and second separator up to reaching a position external to the stack being formed;

moving back said table and withdrawing the sheet stretching board, with said portion of wing that remains between said stack and said table.

Advantageously, before moving back the table a step is provided where an element moving from a direction opposite to the sheet stretching board stretches the portion of wing of sheet exceeding the sheet stretching board.

Furthermore, a step can be provided of making an end fold on the portion of said wing exceeding said sheet stretching board by means of both an element moving from the opposite side of said sheet stretching board and an element moving from the same side of said sheet stretching board, before moving back said table.

Advantageously, an end fold can be obtained by using, as element moving from the opposite side of the sheet stretching board, the corresponding separator, and by using as element moving from the same side of said sheet stretching board a blow of air. In particular, the separator, starting from a position outer to the stack, after that the sheet stretching board is positioned, is brought below the lower face of the sheet stretching board, in order to make the end fold on the exceeding portion of sheet by the blow of air.

Advantageously, before positioning the completed stack on the conveyor belt a blow of air is provided for moving a possible last sheet that has remained in a vertical position up to an horizontal position.

According to another aspect of the invention an apparatus for separating a stack of sheets already formed from a stack being formed during the production of paper products in interfolded stacks comprises:

means for providing a stack of interfolded sheets;

a movable table for allowing progressively the growth of the stack and for then moving away the formed stack;

a first and a second separator that are moved laterally into the stack and from opposite sides with respect to the stack same for about half of its width in order to obtain the disengagement of the stack from the stack located underneath and to leave a wing of sheet hanging free between said two separators;

characterised in that it comprises furthermore:

a sheet stretching board suitable for provisionally supporting the stack and stretching said or each wing, with a portion of wing of sheet exceeding the sheet stretching board.

Advantageously, an element is also provided moving from a direction opposite to the sheet stretching board, with respect to the processed stack, suitable for stretching the portion of wing of sheet exceeding the sheet stretching board before moving back the table.

Since the separators are inserted only for a portion of the width of the stack, it is possible to position them so that their trajectory during the operation do not cross the outline of the folding rollers. Therefore, there is the double advantage of using folding rollers having less deep grooves and working with speed higher than the prior art, owing to the lower stroke of the separator from the rest position to that of separation.

The handling of the first and of the second separator is obtained by means of a combination of movements that allows their introduction into the stack of interfolded sheets. In particular, each separator is engaged to a support operatively coupled to a connecting rod operated by a motor. This connecting rod rotates by means of a cam and acts on the support through a reciprocation that causes its rotation about a first and a second pivot of an articulated quadrilateral associated to a movable carriage along a sliding direction. This way, it is possible to obtain a substantially straight trajectory of the separators and high working speeds.

Advantageously, the sheet stretching board can slide on a base integral to the support of the first separator in a direction orthogonal to the sliding direction operated by an actuator that causes it to move along this direction.

Also the table is advantageously withdrawn owing to a slide movable horizontally along a guide operated by an actuator. Furthermore, since the table must slide in a vertical direction in synchronism with the separators, but independently from them, it is slidingly mounted on the same vertical guide along which the separator slides, but on a different vertical carriage.

Advantageously, said element acting opposite with respect to the sheet stretching board is a flow of fluid, for example, a blow of air.

BRIEF DESCRIPTION THE INVENTION

Further characteristics and the advantages of the method and of the apparatus, according to the invention, for separating two successive interfolded sheets, during the production of paper packages, will be made clearer with the following description of an embodiment thereof, exemplifying but not limitative, with reference to the attached drawings, wherein:

FIGS. from 1 to 6 show diagrammatically a possible succession of steps, through which the method is carried out for separating two successive interfolded sheets, during the production of paper packed products, according to the invention;

FIGS. from 7 to 10 show diagrammatically a succession of steps alternative to that shown in FIGS. from 4 to 6, in order to make an end fold on the portion of wing exceeding the sheet stretching board;

DESCRIPTION OF THE INVENTION

Figure 1:
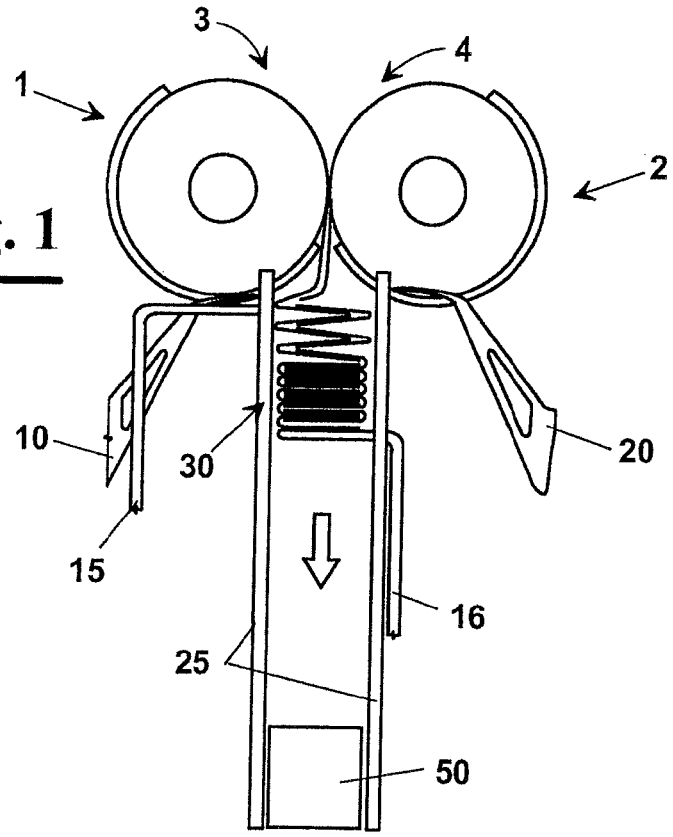

With reference to FIGS. from 1 to 6, the succession of steps through which the method is operated for separating two successive interfolded sheets, during the production of paper packed products, according to a first embodiment of the invention, provides the feeding of two webs of sheets according to arrows 3 and 4 on a couple of folding counter rotating rollers 1 and 2 and arranged with a plurality of means, not shown, which keep selectively the sheets on their surface.

As known, by means of suitable folding arms, which are also not shown, the sheets are supplied interfolded by rollers 1 and 2 on a table 16 on which they are piled up forming a stack 30. The stack 30 is contained laterally between two vertical grids 25 that define a containing column at the end of which it is provided a conveyor 50.

Figure 2:
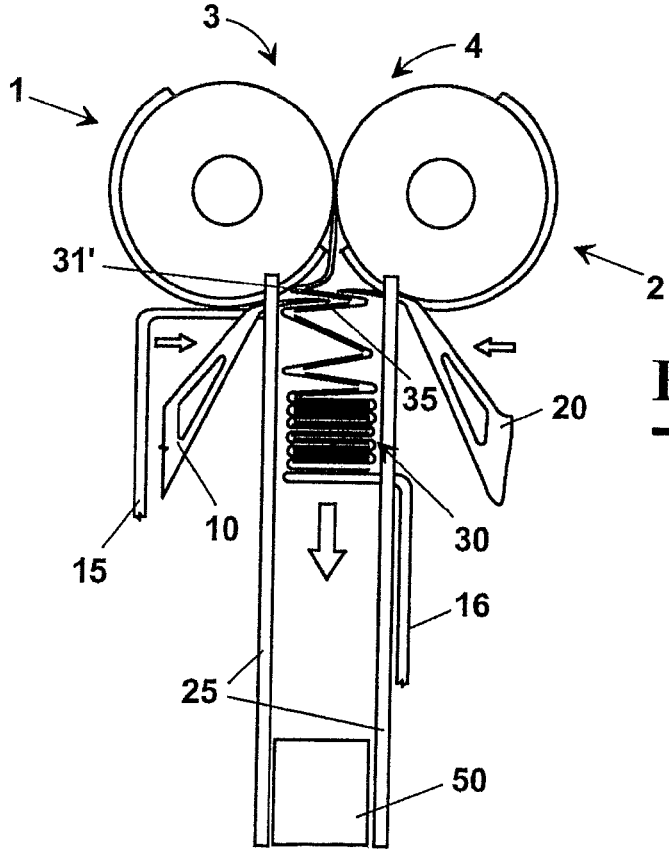
Figure 3:
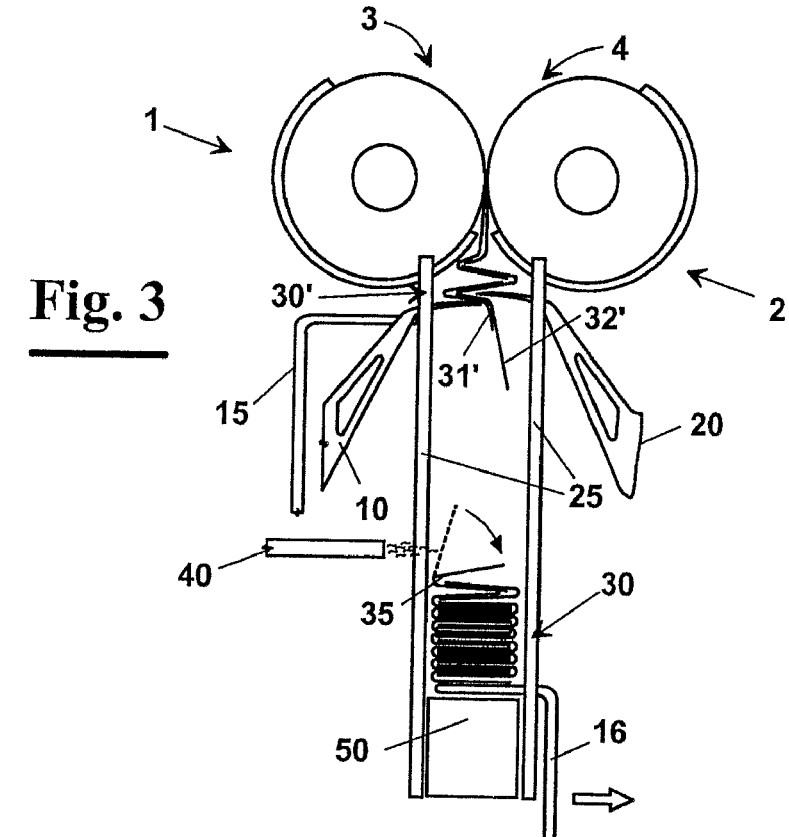
Figure 12:
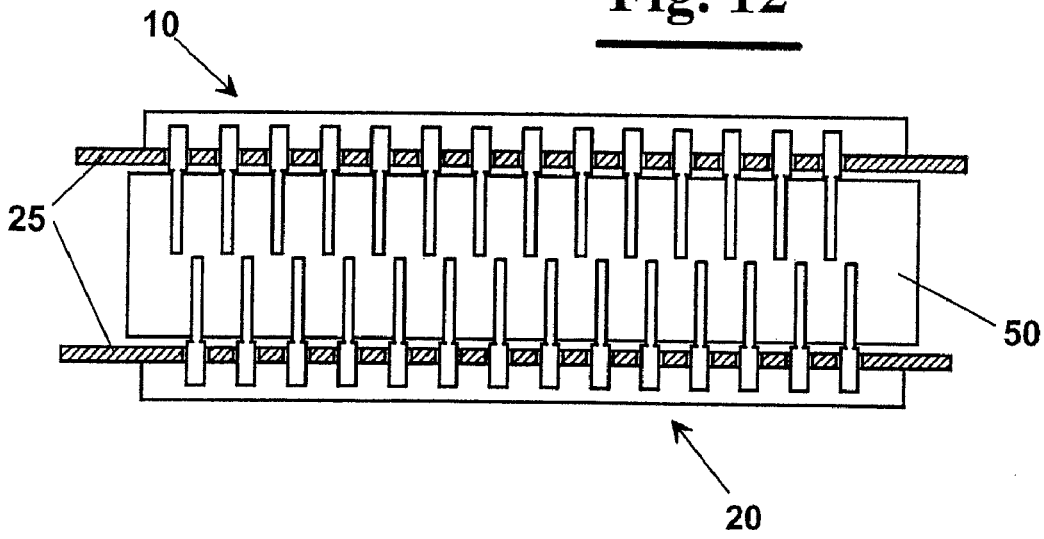
FIG. 12 shows diagrammatically in a top plan partial view the apparatus of FIG. 11.

When the stack 30 achieves a predetermined height a first plurality of separators 10 and a second plurality of separators 20, arranged for all the length of the stack 30 and from opposite sides with respect to the stack according to a configuration substantially comb-like (FIG. 12), are inserted into the stack same (FIG. 2). This introduction is to provide the disengagement of the stack 30 already formed from a stack being formed 30', leaving between them of a hanging wing of sheet 31' (FIG. 3).

Figure 4:
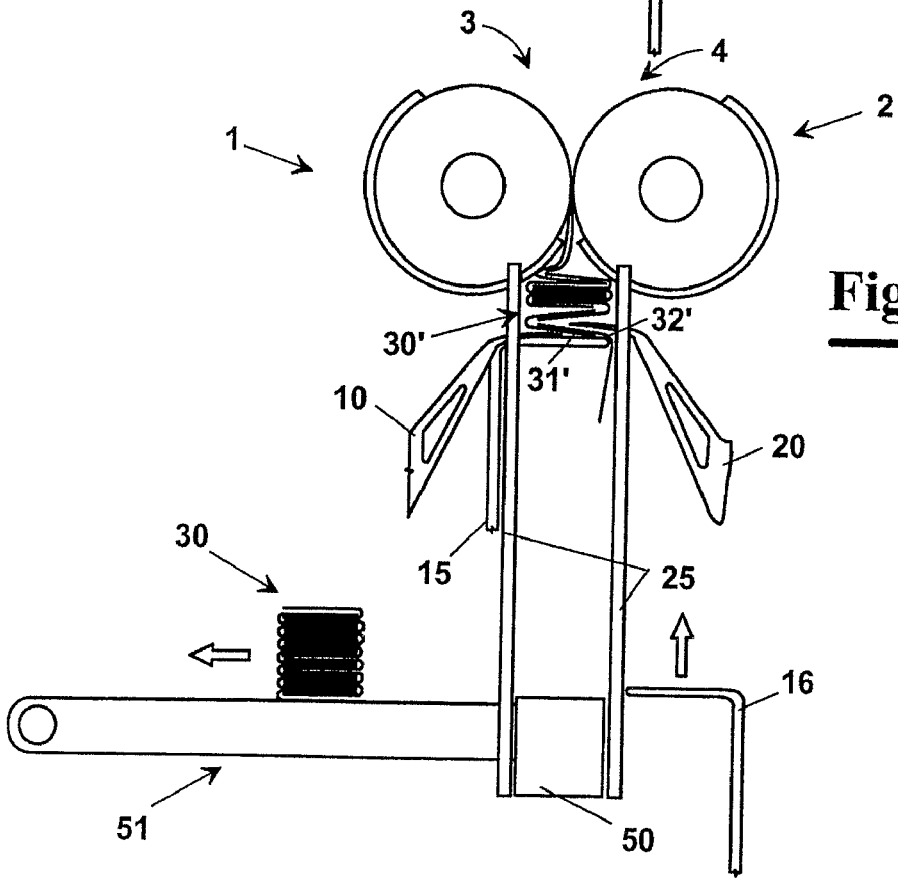

The stack formed 30 is then withdrawn quickly from stack 30' by means of table 16, which translates vertically, and is subject to a blow of air 40 for stretching a possible last sheet 35 still in a vertical position and bringing it to an horizontal position. Then, the stack formed 30 is left on a longitudinal conveyor belt 50 located underneath and is transferred (in a direction towards the depth of the figure) out the machine on another conveyor belt 51 and then subject to further operations (FIG. 4). At the same time, a sheet stretching board 15 that is located outer to grid 25 moves under the stack of interfolded sheets 30', for all its length, with the duty of provisional support thereof. In particular, the sheet stretching board 15 stretches completely the wing 31' hanging from stack 30' with a portion of wing 32' that exceeds sheet stretching board 15. After locating sheet stretching board 15 under the stack, there is the withdrawal from the position under stack 30' of separators 10 and 20 that move outside vertical grid 25.

Figure 5:
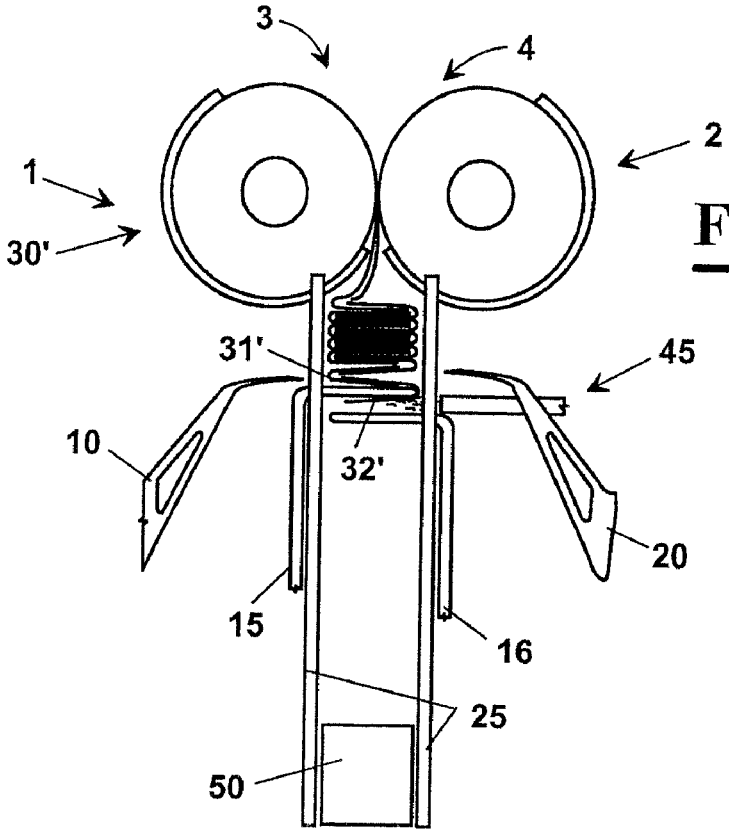
Figure 6:
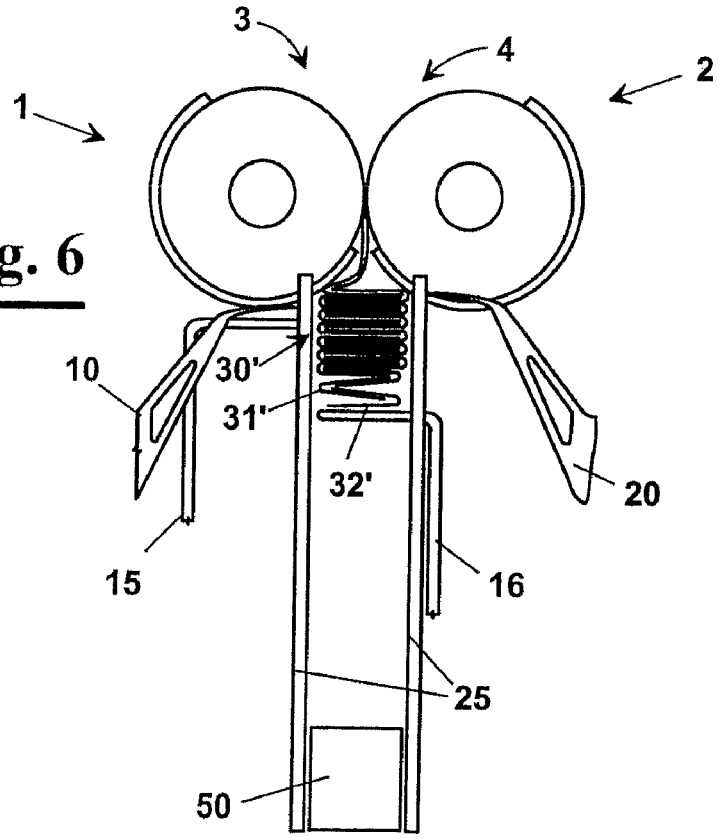

Then, an element moving from a direction opposite to sheet stretching board 15, for example, a blow of air 45, as shown in FIG. 5, stretches the portion of the exceeding wing of sheet 32' just before that the table 16 moves back (FIG. 6).

In FIGS. from 7 to 10 the succession is diagrammatically shown of the steps, according to the invention, for carrying out an end fold 33' (FIG. 10) on the portion of wing 32' exceeding the sheet stretching board 15.

Figure 7:
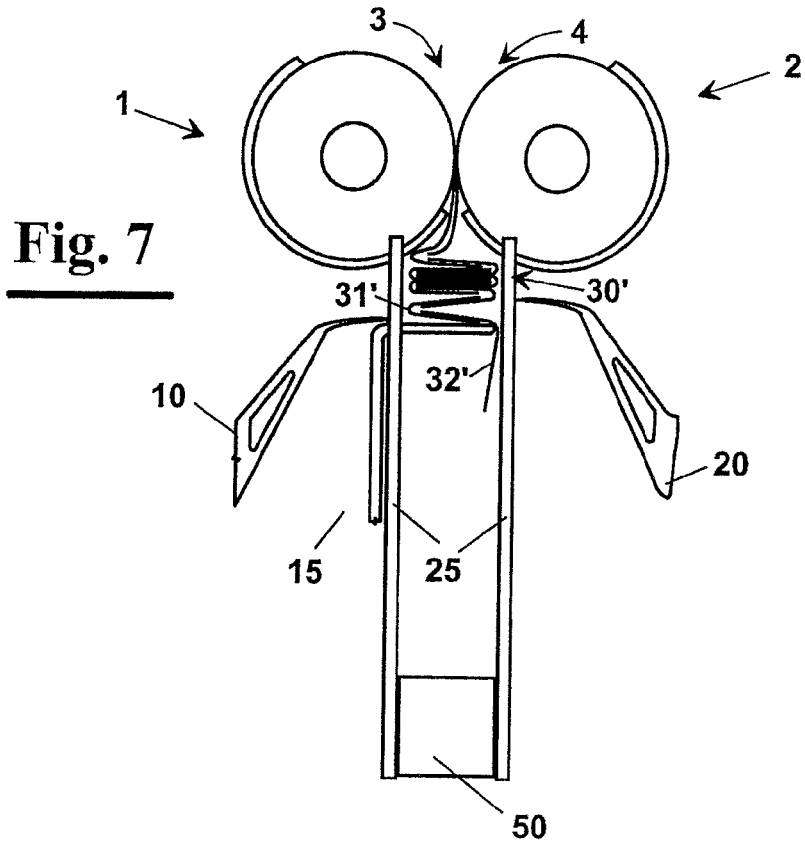
Figure 8:
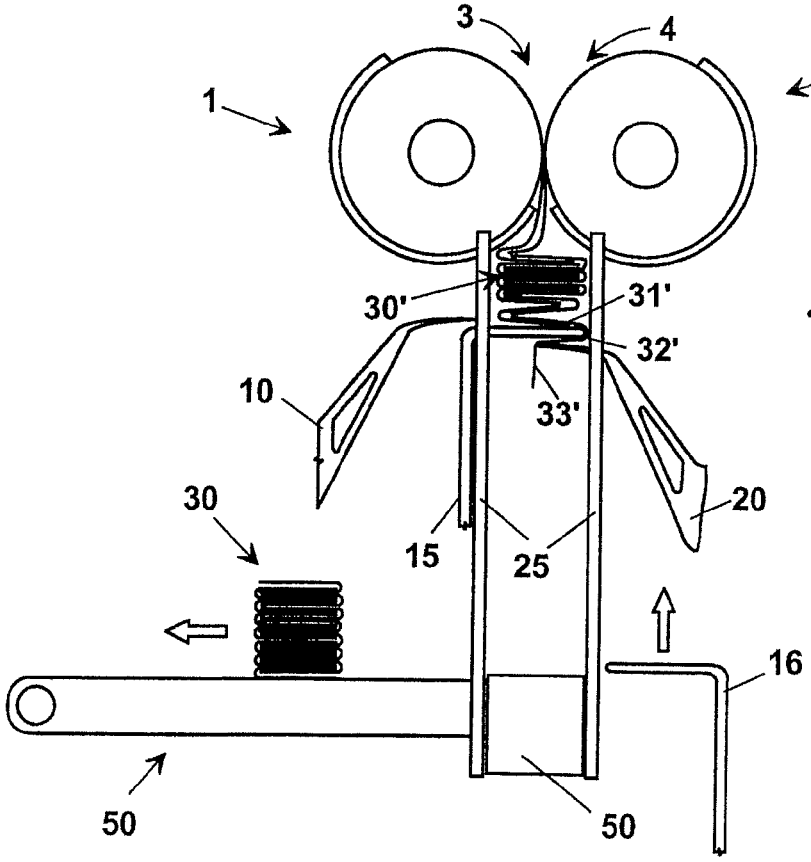

In particular, at first the introduction is carried out of separators 10 and 20 into the stack 30, thus causing the disengagement thereof from the stack being formed 30', similarly to what described for the previous case (FIG. 1-4). Then, separator 20 is lowered outside vertical grids 25 (FIG. 7) and brought below the lower face of the sheet stretching board 15. This causes portion of wing 32' to fold up to reaching a shape 33' (FIG. 8). A blow of air 46 coming from the opposite part of separator 20 achieves then an end fold 34' on wing 32' (FIG. 9) just before that table 16 comes back and then presses end fold 34' onto same (FIG. 10).

Figure 11:
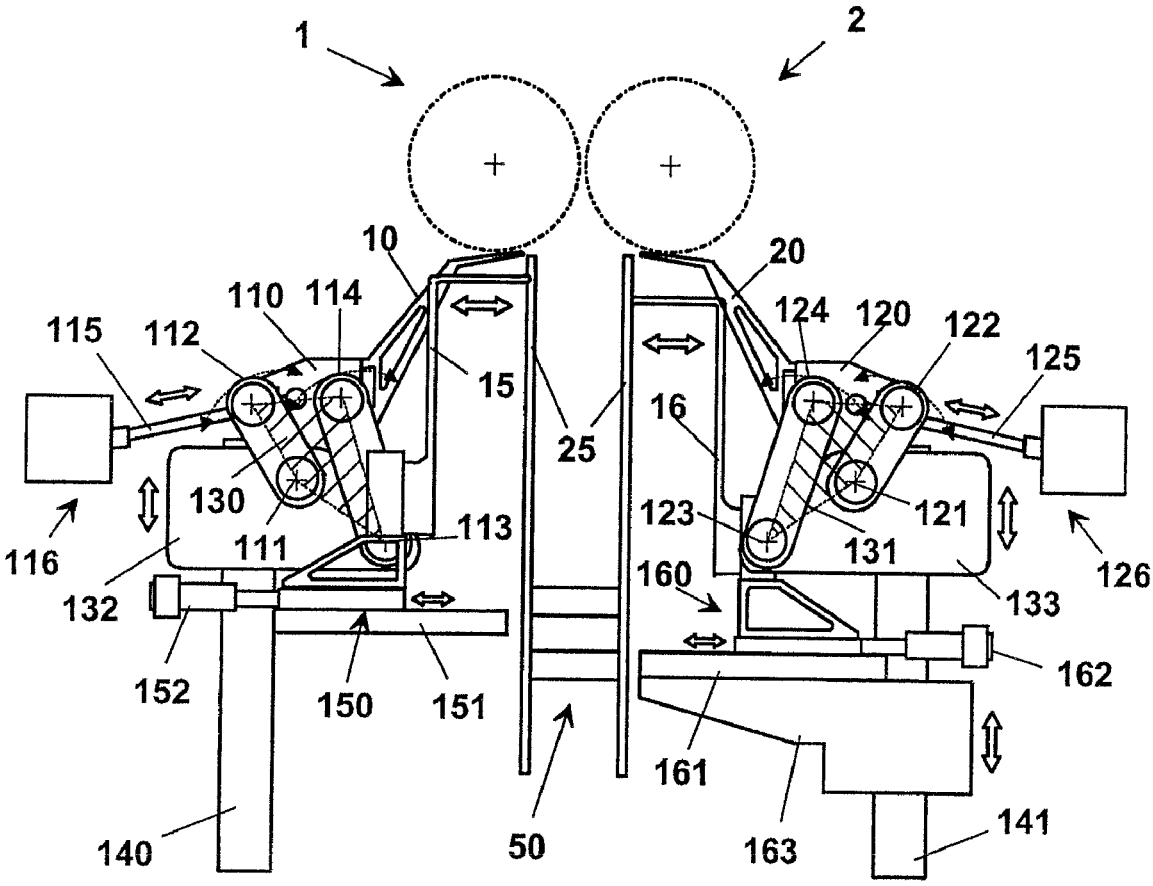
FIG. 11 shows diagrammatically in an elevational front view the apparatus for separating two successive interfolded sheets, during the production of paper packed products, according to the invention.

The handling of the first and of the second separator 10 and 20 is diagrammatically shown in FIG. 11. In particular, each separator 10 or 20 is connected to a support 110 or 120 operatively coupled to a connecting rod 115 or 125 operated by a motor 116 or 126 indicated diagrammatically. This connecting rod 115 or 125 rotates by means of a cam 117 or 127 and acts on support 110 with a reciprocation that causes its rotation about a first pivot 111 or 121 and a second pivot 113 or 123 of an articulated quadrilateral 130 or 131 hinged on a carriage 132 or 133 movable on a vertical guide 140 or 141 along a sliding direction. This way, it is possible to provide a trajectory substantially straight of the separators and to obtain high working speeds.

Such type of mechanism allows the introduction of the separators 10 and 20 in the stack 30 of interfolded sheets processed according to a substantially straight trajectory and allows to working at high speed.

Always with reference to FIG. 11, the sheet stretching board 15 is movable in a vertical direction integrally to the support 110 of separator 10 and along an horizontal direction operated by an actuator 152 that causes its base 150 to move along a slide 151.

Similarly, table 16 is located on a slide 160 movable horizontally along a guide 161 operated by an actuator 162.

Furthermore, since the table 16 must slide in a vertical direction in synchronism with the separators 10 and 20, but independently from them, it is slidingly mounted on the same vertical guide 141 along which the separator slides 20, but on a vertical sliding carriage 163.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. A method for separating a stack of sheets already formed from a stack being formed, during the production of paper packed products, comprising the steps of:

a) forming a stack of interfolded sheets piling up on a table located underneath;

b) separating two successive interfolded sheets once achieved a predetermined height of said forming stack and defining a formed stack and a forming stack;

c) said separating occurring by laterally introducing a first and a second separator into said forming stack from opposite sides with respect to the forming stack for separating the forming stack from the formed stack located underneath on said table;

c1) said forming stack having a width and said two separators being introduced from opposite sides between said forming stack and said formed stack for about half of said width such that said separators bear together said forming stack;

c2) said two separators leaving at least one wing of sheet hanging free between said two separators, said wing hanging at about half of said width;

d) moving away said formed stack from by said table;

e) after that said formed stack has been moved away by said table, moving a sheet stretching board under the forming stack for all the stack width to provisionally support said forming stack and for stretching said or each wing for all the stack width, with an end portion of said wing eventually exceeding said sheet stretching board;

f) withdrawing said first and second separator up to reaching a position external to said stack being formed while said sheet stretching board continues to support the forming stack, and moving away said first and second separator independently from said sheet stretching board;

g) leaving said formed stack by sad table on a conveyor belt or an outlet plane;

h) moving back said table up to reaching said sheet stretching board that supports the forming stack; and i) withdrawing the sheet stretching board, with said portion of wing that remains folded between said forming stack and said table.

2. The method of claim 1, wherein before moving back said table an element moving from a direction opposite to said sheet stretching board stretches said portion of wing of sheet exceeding said sheet stretching board.

3. The method of claim 1, wherein a step is provided of making an end fold on the portion of said wing exceeding said sheet stretching board by means of both an element acting from the opposite side to said sheet stretching board and an element acting from the same side of said sheet stretching board, just before coming back said table.

4. The method of claim 3, wherein said element acting from the same side is a blow of air, and said element acting from the opposite side of said sheet stretching board is said second separator, said separator moving from a position outer to the stack, after that said sheet stretching board is positioned, to a position below the lower face of said sheet stretching board and in order to make the end fold on the exceeding portion of sheet by said blow of air.

5. The method of claim 1, wherein previously to the step of moving away said completed stack on the conveyor belt, or in the outlet plane, a blow of air is provided for moving a possible last sheet that has remained in a vertical position bringing it to an horizontal position.

6. An apparatus for separating a formed stack of sheets from a forming stack during the production of paper products in interfolded stacks, comprising:

a) means for feeding said forming stack with a stream of interfolded sheets;

b) a movable table for supporting said forming stack for allowing progressively the growth of the forming stack;

c) a first and a second separator arranged at opposite sides with respect to the forming stack;

d) means for laterally moving from opposite sides said first and second separators into said forming stack, for separating a formed stack located underneath and for provisionally supporting the forming stack, wherein at least one wing of sheet hangs free between said two separators;

e) means for moving away said table with said formed stack such that said table leaves said formed stack on a conveyor belt or an outlet plane;

f) a sheet stretching board;

g) means for moving said sheet stretching board under said first and second separators which provisionally support the forming stack for all the stack width to provisionally support said forming stack and for stretching said or each wing for all the stack width, with an end portion of said wing eventually exceeding said sheet stretching board;

g) means for withdrawing said first and second separators such that said sheet stretching board provisionally supports the stack being formed and for moving away said first and second separators independently from said sheet stretching board; and, h) means for moving said table under said sheet stretching board to support the stack being formed.

7. The apparatus of claim 6, comprising, furthermore, an element moving from a direction opposite to said sheet stretching board, with respect to the processed stack, suitable for stretching said portion of wing of sheet exceeding said sheet stretching board just before coming back said table.

8. The apparatus of claim 6, wherein said element moving from the opposite side of said sheet stretching board is a blow of air.

9. The apparatus of claim 6, wherein said first and second separator are engaged to a support operatively coupled to a connecting rod operated by a motor; said connecting rod rotating by means of a cam and causing the rotation about a first and a second pivot of an articulated quadrilateral associated to a movable carriage along a sliding direction.

10. The apparatus of claim 6, wherein said sheet stretching board slides on a base integral to said support of said first separator in a direction orthogonal to said sliding direction operated by an actuator that causes it to move along this direction.

11. The apparatus of claim 6, wherein said table is located on a slide movable horizontally along a guide operated by an actuator.

12. A method for separating a stack of sheets already formed from a stack being formed, during the production of paper packed products, comprising the steps of:

a) forming a stack of interfolded sheets piling up on a table located underneath, said stack having a width;

b) separating two successive interfolded sheets once achieved a predetermined height of said forming stack and defining a completed stack and a forming stack;

c) said separating occurring by laterally introducing from opposite sides a first and a second separator into a forming stack from opposite sides with respect to the forming stack same for separating a formed stack located underneath from a stack being formed, said separators introduced about half the width and bearing together the stack being formed in order to leave at least one wing of sheet hanging free between said two separators, the two separators leaving the wing hanging at about half of the width;

d) moving away said completed stack of sheets by said table, and causing said table to leave the completed stack on a conveyor belt or an outlet plane;

e) moving a sheet stretching board under the two separators for all the stack width to provisionally support said stack and for stretching said or each wing for all the stack width, with an end portion of said wing eventually exceeding said sheet stretching board;

f) withdrawing said first and second separator up to reaching a position external to said stack being formed, and g) moving back said table and withdrawing the sheet stretching board, with said portion of wing that remains between said stack and said table.

* * * * *